US006303547B1

(12) United States Patent
Balasubramaniam

(10) Patent No.: US 6,303,547 B1
(45) Date of Patent: Oct. 16, 2001

(54) FRICTION MODIFIED LUBRICANTS

(75) Inventor: Vasudevan Balasubramaniam, Montpelier, VA (US)

(73) Assignee: Ethyl Corporation, Richmond, VA (US)

( * ) Notice: Subject to any disclaimer, the term of this patent is extended or adjusted under 35 U.S.C. 154(b) by 0 days.

(21) Appl. No.: 09/665,571

(22) Filed: Sep. 19, 2000

(51) Int. Cl.[7] ..... C10M 129/40
(52) U.S. Cl. ..... 508/454; 508/527; 508/528
(58) Field of Search ..... 508/454, 527, 508/528

(56) References Cited

U.S. PATENT DOCUMENTS

| | | | | |
|---|---|---|---|---|
| 3,749,702 | * | 7/1973 | Boehringer et al. | 508/454 |
| 4,871,465 | * | 10/1989 | Hutchison | 508/454 |
| 4,948,523 | | 8/1990 | Hutchison et al. | 252/47 |
| 4,956,122 | | 9/1990 | Watts et al. | 252/565 |
| 5,080,815 | * | 1/1992 | Fenoglio et al. | 508/454 |
| 5,403,501 | | 4/1995 | Schwind | 252/32.7 |
| 5,883,057 | | 3/1999 | Roell, Jr. et al. | 508/469 |

FOREIGN PATENT DOCUMENTS 0786511 1/1997 (EP) .

OTHER PUBLICATIONS

W.R. Alexander; *Lubrication Requirements of the Mack Heavy–Duty Power Divider*; SAE Paper 650637.

John W. Allen; *Lubricants for Limited Slip Differentials*; SAE Paper 660779.

B.M. O'Connor et al; *Energy Conservation Through The Use of Multigraded Gear Oils In Trucks*; SAE Paper 770833.

B.M. O'Connor et al; *The Relationship Between Laboratory Axle Efficiency and Vehicle Fuel Consumption*; SAE Paper 811206.

W.T. Brannen, et al; *Axle Efficiency*, (Panel Discussion presented at the NLGI 47$^{th}$ Annual Meeting in Toronto, Canada, Oct., 1979.).

B.M. O'Connor, et al; *Axle Efficiency—Response to Synthetic Lubricant Components*; SAE Paper 821181.

V. Bala, et al; *Enhanced Performance Considerations For Automotive Gear Lubricants*; ISFL–2000, Mar. 10–12, 2000 New Delhi; pp. 193–198.

V. Bala, et al; *Rheological Properties Affecting the Fuel Economy of Multigrade Automotive Gear Lubricants*; SAE Paper 2000–01–2051.

V. Bala, et al; *Fuel Economy of Multigrade Gear Lubricants*; Industrial Lubrication and Tribology, vol. 52—No. 4–2000–pp. 165–173.

* cited by examiner

*Primary Examiner*—Jacqueline V. Howard
(74) *Attorney, Agent, or Firm*—Thomas Hamilton; James T. Moore

(57) ABSTRACT

The reaction product of at least one $C_5$–$C_{60}$ carboxylic acid and at least one amine selected from the group consisting of guanidine, aminoguanidine, urea, thioruea and salts thereof is useful as a gear oil additive. The lubricant formulations exhibit excellent low and high temperature rheology and are particularly suited for use in automotive and industrial gear applications. Lubricants of the present invention exhibit improved performance properties, such as increased axle efficiencies and lower axle temperatures, improved limited slip performance, reduced chatter, improved frictional durability and/or improved power divider performance compared to lubricant formulations that do not contain said reaction products.

29 Claims, No Drawings

FRICTION MODIFIED LUBRICANTS

TECHNICAL FIELD

This invention relates to lubricant formulations containing the reaction product of at least one $C_5$–$C_{60}$ carboxylic acid and at least one amine selected from the group consisting of guanidine, aminoguanidine, urea, thioruea and salts thereof. The lubricant formulations of the present invention exhibit excellent low and high temperature rheology and are particularly suited for use in automotive and industrial gear applications. Lubricants of the present invention exhibit improved performance properties, such as increased axle efficiencies and lower axle temperatures, improved limited slip performance, reduced chatter, improved frictional durability and/or improved power divider performance compared to lubricant formulations that do not contain said reaction products.

BACKGROUND INFORMATION

The primary function of a gear lubricant is to provide a high degree of reliability and durability in the service life of gear equipment. Gear lubricants may also contribute to improving the fuel economy of vehicles by improving the axle efficiency. See, for example, O'Connor et al., *The Relationship Between Laboratory Axle Efficiency and Vehicle Fuel Consumption* (SAE Paper No. 811206).

In the paper by O'Connor et al., entitled *Axle Efficiency—Response to Synthetic Lubricant Components* (SAE Paper No.821181), the authors state that "[i]nvestigations with both partial- and full-synthetic base formulations have shown improvements compared to conventional petroleum base gear oils. Maximum benefits are gained with total synthetic base type formulations."

Limited slip differentials are designed to restrict differentiation in a vehicle operating on a slippery surface. The limited slip characteristic is obtained by modifying a standard differential with the addition of a clutch. This clutch has the property of forcing both axle shafts to turn with the ring gear when the vehicle operates on a slippery surface. Limited slip differentials contain a slow-moving clutch. At low sliding velocities this clutch is prone to stick and then slip in a repetitive fashion unless a lubricant with the proper frictional characteristics is used. This stick-slip effect is very objectionable as it can result in loud chatter noises and severe vibration. The paper by John W. Allen, entitled *Lubricants for Limited Slip Differentials* (SAE Paper No. 660779), provides some background on the problems associated with limited slip differentials and some proposed lubricant solutions. The Allen paper does not teach or suggest the additives of the present invention or their use in lubricant formulations.

Power dividers are the linkages in the drivetrain that direct engine torque to gripping wheels rather than slipping wheels. The power divider's application is similar to the limited slip clutches in light duty axles. There are many types of power dividers, their overall purpose is to transmit torque to both sets of wheels or between the front and rear axles. In one particular design, this is accomplished by using a set of wedges between two cylindrical cams whose mating surfaces with the wedges are lobed. These lock for transmittal but slide to avoid torque buildup. When too much torque has built up without sliding, the wedges break the momentary welds formed. This is accompanied by a loud snap that can propel the truck sideways. Malfunctioning power dividers can result in broken axles.

Hutchison et al., in U.S. Pat. No. 4,948,523, discloses a lubricating composition that contains a silver protective agent. The silver protective agent comprises the reaction product of a $C_5$–$C_{60}$ carboxylic acid and at least one amine selected from the group consisting of: 1) guanidine, urea and thioruea compounds; 2) $C_1$–$C_{20}$ hydrocarbyl or hydroxy-substituted hydrocarbyl mono-amines, alkylene diamines; and 3) polyalkylene polyamines and N-alkyl glycine. This patent is directed to lubricating oil additives for medium speed diesel engines, such as locomotive engines, which have silver parts in the engine. Large, medium-speed diesel engines often contain silver protected components, such as bearings, and, as such, the lubricating oils may not contain the typical zinc containing wear inhibitors which attack the silver coated parts. This patent does not teach the use of the reaction products of the present invention in gear oil formulations or the improvements in, for example, axle efficiency, limited slip performance or power divider performance exhibited by the compositions of the present invention.

SUMMARY OF THE INVENTION

The present invention is directed to a lubricant composition comprising:

(A) an oil of lubricating viscosity;

(B) the reaction product of at least one $C_5$–$C_{60}$ carboxylic acid and at least one amine selected from the group consisting of guanidine, aminoguanidine, urea, thioruea and salts thereof; and (C) a gear additive package.

The lubricant formulations of the present invention exhibit excellent low and high temperature rheology and are particularly suited for use in automotive and industrial gear applications. The lubricant formulations of the present invention exhibit improved performance properties such as increased axle efficiencies and lower axle temperatures, improved limited slip performance, reduced chatter, improved frictional durability and/or improved power divider performance compared to lubricant formulations that do not contain said reaction products. Further, the present invention is directed to the use of the reaction product (B) as an additive for increasing axle efficiencies, lowering axle temperatures, improving limited slip performance, reducing chatter, improving frictional durability in steel-on-steel and steel-on-paper applications and improving power divider performance in automotive and industrial gear applications.

DETAILED DESCRIPTION OF THE INVENTION

One embodiment of the present invention is directed to a lubricant composition comprising:

(A) from about 40 to about 85 weight percent (wt. %), based on the total weight of the lubricant composition, of an oil of lubricating viscosity;

(B) from about 0.01 to about 5 wt. %, based on the total weight of the lubricant composition, of the reaction product of at least one $C_5$–$C_{60}$ carboxylic acid and at least one amine selected from the group consisting of guanidine, aminoguanidine, urea, thioruea and salts thereof; and (C) from 2 to 25 wt. %, based on the total weight of the lubricant composition, of a gear additive package.

Oils of lubricating viscosity contemplated for use as component (A) in the present invention include natural lubricating oils, synthetic lubricating oils and mixtures thereof. Suitable lubricating oils also include basestocks obtained by isomerization of synthetic wax and slack wax, as well as basestocks produced by hydrocracking the aromatic and polar components of the crude. In general, both the natural and synthetic lubricating oils will each have a kinematic viscosity ranging from about 1 to about 40 $mm^2/s$ (cSt) at 100° C., although typical applications will require each of the base oils to have a viscosity ranging from about 1 to about 12, preferably 2 to 8, $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

The mineral oils useful in this invention include all common mineral oil base stocks. This would include oils that are naphthenic or paraffinic in chemical structure. Oils that are refined by conventional methodology using acid, alkali, and clay or other agents such as aluminum chloride, or be extracted oils produced, for example, by solvent extraction with solvents such as phenol, sulfur dioxide, furfural, dichlordiethyl ether, etc. They may be hydrotreated or hydrorefined, dewaxed by chilling or catalytic dewaxing processes, or hydrocracked. The mineral oil may be produced from natural crude sources or be composed of isomerized wax materials or residues of other refining processes. In a preferred embodiment, the oil of lubricating viscosity is a hydrotreated, hydrocracked and/or iso-dewaxed mineral oil having a Viscosity Index (VI) of greater than 80, preferably greater than 90; greater than 90 volume % saturates and less than 0.03 wt. % sulfur.

Group II and Group III basestocks are particularly suitable for use in the present invention, and are typically prepared from conventional feedstocks using a severe hydrogenation step to reduce the aromatic, sulfur and nitrogen content, followed by dewaxing, hydrofinishing, extraction and/or distillation steps to produce the finished base oil. Group II and III basestocks differ from conventional solvent refined Group I basestocks in that their sulfur, nitrogen and aromatic contents are very low. As a result, these base oils are compositionally very different from conventional solvent refined basestocks. The American Petroleum Institute has categorized these different basestock types as follows: Group I, >0.03 wt. % sulfur, and/or <90 vol % saturates, viscosity index between 80 and 120; Group II, ≦0.03 wt. % sulfur, and ≧90 vol % saturates, viscosity index between 80 and 120; Group III, ≦0.03 wt. % sulfur, and ≧90 vol % saturates, viscosity index >120; Group IV, poly-alpha-olefins. Hydrotreated basestocks and catalytically dewaxed basestocks, because of their low sulfur and aromatics content, generally fall into the Group II and Group III categories.

There is no limitation as to the chemical composition of the various basestocks used. For example, the proportions of aromatics, paraffinics, and naphthenics in the various Group I, Group II and Group III oils can vary substantially. The degree of refining and the source of the crude used to produce the oil generally determine this composition.

In a preferred embodiment, the base oil comprises a mineral oil having a VI of at least 110.

The lubricating oils may be derived from refined, re-refined oils, or mixtures thereof. Unrefined oils are obtained directly from a natural source or synthetic source (e.g., coal, shale, or tar sands bitumen) without further purification or treatment. Examples of unrefined oils include shale oil obtained directly from a retorting operation, petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Re-refined oils are obtained by treating used oils in processes similar to those used to obtain the refined oils. These re-refined oils are also known as reclaimed or reprocessed oils and are often additionally processed by techniques for removal of spent additives and oil breakdown products.

Synthetic lubricating oils include hydrocarbon oils and halo-substituted hydrocarbon oils such as oligomerized, polymerized, and interpolymerized olefins; alkylbenzenes; polyphenyls; and alkylated diphenyl ethers, alkylated diphenyl sulfides, as well as their derivatives, analogs, and homologs thereof, and the like. Preferred synthetic oils are oligomers of α-olefins, particularly oligomers of 1-decene, having a viscosity ranging from about 1 to about 12, preferably 2 to 8, $mm^2/s$ (cSt) at 100° C. These oligomers are known as poly-α-olefins or PAOs.

Synthetic lubricating oils also include alkylene oxide polymers, interpolymers, copolymers, and derivatives thereof where the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 100–1500); and mono- and poly-carboxylic esters thereof (e.g., the acetic acid esters, mixed $C_3$–$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, subric acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl isothalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils are adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaeythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetra-ethyl silicate, tetra-isopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)-siloxanes and poly (methylphenyl) siloxanes, and the like. Other synthetic lubricating oils include liquid esters of phosphorus containing acids (e.g., tricresyl phosphate, trioctylphosphate, and diethyl ester of decylphosphonic acid), polymeric tetra-hydrofurans, poly-alpha-olefins, and the like.

Component (B) of the present invention comprises the reaction product of at least one $C_5$–$C_{60}$ carboxylic acid and at least one amine selected from the group consisting of guanidine, aminoguanidine, urea, thioruea and salts thereof as taught in U.S. Pat. No. 4,948,523, incorporated herein by reference for relevant disclosures contained therein.

The reaction product(s) useful as component (B) in the lubricant compositions of the present invention are oil-soluble reaction products obtained by reacting at least one amine compound with at least one $C_5$–$C_{60}$ carboxylic acid. The amine compound(s) is selected from the group consisting of guanidine, aminoguanidine, urea, thioruea and salts thereof. The amines useful in preparing the reaction product (s) have the general formula:

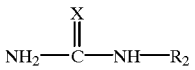

wherein X is —$NR_1$, O or S, wherein $R_1$ is H or $C_1$–$C_{15}$ hydrocarbyl; $R_2$ is H, —NR'R" or $C_1$ to $C_{20}$ hydrocarbyl or hydroxy-substituted hydrocarbyl wherein R' and R" (being the same or different) are H or $C_1$ to $C_{20}$ hydrocarbyl or hydroxy-substituted hydrocarbyl; or salts of said compounds.

Generally speaking, the additive reaction products described for use in the compositions according to the present invention can be obtained by reacting at least one $C_5$–$C_{60}$ aliphatic carboxylic acid with at least one amine selected from guanidine, aminoguanidine, urea, thioruea and salts thereof. Preferred for use in the present invention are the inorganic salts of aminoguanidine compounds wherein the anion is halide, carbonate, nitrate, phosphate, orthophosphate and the like. A particularly preferred aminoguanidine derivative for the preparation of the additive used in the present invention is aminoguanidine bicarbonate. The guanidine, aminoguanidine, urea and thioruea used herein are available from commercial sources or can be readily prepared using well known techniques.

The reaction temperature for the reaction between the amine and the carboxylic acid is preferably in the range from about 50° C. to 190° C. Examples of carboxylic acids suitable for preparing the additive reaction products of the present invention include the saturated aliphatic monocarboxylic acids such as valeric, caproic, caprylic, lauric, palmitic, stearic and the like. Saturated aliphatic dicarboxylic acids such as glutaric, adipic and the like are also useful. Cycloaliphatic acids, unsaturated aliphatic monocarboxylic acids such as oleic, linoleic and mixtures thereof and unsaturated dicarboxylic acids may also be used. If a dicarboxylic acid is used, then 2 moles of the amine can be reacted per mole of carboxylic acid. The dimerized fatty acids, preferably those containing conjugated unsaturation, are also useful in preparing the reaction product (B).

Representative of the carboxylic acids useful herein include the commercially available fatty acids, or mixtures thereof, derived from sources such as corn oil, soybean oil, palm oil, tung oil, sunflower oil, cottonseed oil, palm kernel oil, olive oil and the like. Particularly preferred are the mono-carboxylic unsaturated fatty acids such as oleic acid, linoleic acid and mixtures thereof. As used herein and in the claims, the term "carboxylic acid" includes the reactive derivatives thereof such as the carboxylic acid anhydrides.

The reaction between the amine and the carboxylic acid is a condensation reaction. In carrying out the reaction, the mole ratio of the amine to carboxylic acid is typically in the range from about 0.6:1 to about 1.3:1 and is preferably 0.9:1 to about 1:1. A reaction temperature of from about 50° to about 190° C. is acceptable and the range of about 90 to about 150° C. is preferred. Reaction times may vary, but typically range from about 1 hour to about 10 hours and preferably from about 1.5 to about 4 hours. The reaction can be carried out in any suitable solvent, a preferred solvent being toluene.

The characterization of the reaction product obtained by reacting the carboxylic acid with the amine is not exactly known. In a preferred embodiment, the reaction product (B) of the present invention is obtained by reacting oleic acid with aminoguanidine bicarbonate. The principal component of the reaction product of aminoguanidine and oleic acid is an aminoguanidine oleamide. However, the reaction product will typically contain minor proportions of other species.

The gear additive package useful as component (C) in the present invention typically contains one or more additives selected from the group consisting of dispersants, corrosion inhibitors, extreme pressure additives, anti-wear additives, rust inhibitors, antioxidants, deodorizers, defoamers, demulsifiers, dyes, friction modifiers other than component (B) and fluorescent coloring agents. The gear additive package may be, although it does not have to be, a fully-formulated gear additive package, such as a package meeting the requirements for API GL-5 and/or API MT-1 and/or MIL-PRF-2105E and/or AGMA 9005-D94. The components present in the gear additive package will depend on the intended final use of the product.

The gear additive package is typically present in an amount of from about 2 to about 25 weight percent, based on the total weight of the lubricating oil composition.

The dispersants useful in the present invention comprise at least one oil-soluble ashless dispersant having a basic nitrogen and/or at least one hydroxyl group in the molecule. Suitable dispersants include alkenyl succinimides, alkenyl succinic acid esters, alkenyl succinic ester-amides, Mannich bases, hydrocarbyl polyamines, or polymeric polyamines.

The alkenyl succinimides in which the succinic group contains a hydrocarbyl substituent containing at least 30 carbon atoms are described for example in U.S. Pat. Nos. 3,172,892; 3,202,678; 3,216,936; 3,219,666; 3,254,025; 3,272,746; and 4,234,435. The alkenyl succinimides may be formed by conventional methods such as by heating an alkenyl succinic anhydride, acid, acid-ester, acid halide, or lower alkyl ester with a polyamine containing at least one primary amino group. The alkenyl succinic anhydride may be made readily by heating a mixture of olefin and maleic anhydride to, for example, about 180–220° C. The olefin is preferably a polymer or copolymer of a lower mono-olefin such as ethylene, propylene, 1-butene, isobutene and the like and mixtures thereof. The more preferred source of alkenyl group is from polyisobutene having a gel permeation chromotography (GPC) number average molecular weight of up to 10,000 or higher, preferably in the range of about 500 to about 2,500, and more preferably in the range of about 800 to about 1,500.

As used herein the term "succinimide" is meant to encompass the completed reaction product from reaction between one or more polyamine reactants and a hydrocarbon-substituted succinic acid or anhydride (or like succinic acylating agent), and is intended to encompass compounds wherein the product may have amide, amidine, and/or salt linkages in addition to the imide linkage of the type that results from the reaction of a primary amino group and an anhydride moiety.

The various types of ashless dispersants described above can be phosphorylated by procedures described in U.S. Pat.

Nos. 3,184,411; 3,342,735; 3,403,102; 3,502,607; 3,511,780; 3,513,093; 3,513,093; 4,615,826; 4,648,980; 4,857,214 and 5,198,133.

The dispersants of the present invention may be boronated. Methods for boronating (borating) the various types of ashless dispersants described above are described in U.S. Pat. Nos. 3,087,936; 3,254,025; 3,281,428; 3,282,955; 2,284,409; 2,284,410; 3,338,832; 3,344,069; 3,533,945; 3,658,836; 3,703,536; 3,718,663; 4,455,243; and 4,652,387.

Preferred procedures for phosphorylating and boronating ashless dispersants such as those referred to above are set forth in U.S. Pat. Nos. 4,857,214 and 5,198,133.

The amount of ashless dispersant, when present, on an "active ingredient basis" (i.e., excluding the weight of impurities, diluents and solvents typically associated therewith) is generally within the range of about 0.5 to about 7.5 weight percent (wt %), typically within the range of about 0.5 to 5.0 wt %, preferably within the range of about 0.5 to about 3.0 wt %, and most preferably within the range of about 2.0 to about 3.0 wt %, based on the finished oil.

The lubricant compositions of the present invention typically will contain some inhibitors. The inhibitor components serve different functions including rust inhibition, corrosion inhibition and foam inhibition. The inhibitors may be introduced in a pre-formed additive package that may contain in addition one or more other components used in the compositions of this invention. Alternatively these inhibitor components can be introduced individually or in various subcombinations. While amounts can be varied within reasonable limits, the finished fluids of this invention will typically have a total inhibitor content in the range of about 0 to about 10 wt %, on an "active ingredient basis", i.e., excluding the weight of inert materials such as solvents or diluents normally associated therewith.

Foam inhibitors form one type of inhibitor suitable for use as inhibitor components in the compositions of this invention. These include silicones, polyacrylates, surfactants, and the like.

Copper corrosion inhibitors constitute another class of additives suitable for inclusion in the compositions of this invention. Such compounds include thiazoles, triazoles and thiadiazoles. Examples of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis(hydrocarbyldithio)-1,3,4-thiadiazoles. The preferred compounds are the 1,3,4-thiadiazoles, a number of which are available as articles of commerce, and also combinations of triazoles such as tolyltriazole with a 1,3,5-thiadiazole such as a 2,5-bis(alkyldithio)-1,3,4-thiadiazole. Materials of these types that are available on the open market include Cobratec™ TT-100 and HiTEC® 314 additive and HiTEC® 4313 additive (Ethyl Petroleum Additives, Inc.). The 1,3,4-thiadiazoles are generally synthesized from hydrazine and carbon disulfide by known procedures. See, for example, U.S. Pat. Nos. 2,765,289; 2,749,311; 2,760,933; 2,850,453; 2,910,439; 3,663,561; 3,862,798; and 3,840,549.

Rust or corrosion inhibitors comprise another type of inhibitor additive for use in this invention. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like. Products of this type are currently available from various commercial sources, such as, for example, the dimer and trimer acids sold under the HYSTRENE trademark by the Humko Chemical Division of Witco Chemical Corporation and under the EMPOL trademark by Henkel Corporation. Another useful type of rust inhibitor for use in the practice of this invention is comprised of the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like. Materials of these types are available as articles of commerce. Mixtures of such rust or corrosion inhibitors can be used.

Antioxidants may also be present in the lubricant formulations of the present invention. Suitable antioxidants include phenolic antioxidants, aromatic amine antioxidants, sulfurized phenolic antioxidants, and organic phosphites, among others. Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butylphenol), mixed methylene-bridged polyalkyl phenols, and 4,4'-thiobis(2-methyl-6-tert-butylphenol). N,N'-di-sec-butyl-p-phenylenediamine, 4-isopropylaminodiphenyl amine, phenyl-naphthyl amine, phenyl-naphthyl amine, and ring-alkylated diphenylamines serve as examples of aromatic amine antioxidants. Preferred are the sterically hindered tertiary butylated phenols, the ring alkylated diphenylamines and combinations thereof.

The amounts of the inhibitor components used will depend to some extent upon the composition of the component and its effectiveness when used in the finished composition.

However, generally speaking, the finished fluid will typically contain the following concentrations (weight percent) of the inhibitor components (active ingredient basis):

| Inhibitor | Typical Range | Preferred Range |
|---|---|---|
| Foam inhibitor | 0 to 0.2 | 0.01 to 0.08 |
| Copper corrosion inhibitor | 0 to 3 | 0.01 to 1 |
| Rust inhibitor | 0 to 3 | 0.01 to 0.3 |
| Antioxidant | 0 to 2 | 0 to 0.6 |

Various types of sulfur-containing antiwear and/or extreme pressure agents can be used in the practice of the present invention. Examples include dihydrocarbyl polysulfides; sulfurized olefins; sulfurized fatty acid esters of both natural and synthetic origins; trithiones; sulfurized thienyl derivatives; sulfurized terpenes; sulfurized oligomers of $C_2$–$C_8$ monoolefins; and sulfurized Diels-Alder adducts such as those disclosed in U.S. reissue patent Re 27,331. Specific examples include sulfurized polyisobutene, sulfurized isobutylene, sulfurized diisobutylene, sulfurized triisobutylene, dicyclohexyl polysulfide, diphenyl polysulfide, dibenzyl polysulfide, dinonyl polysulfide, and mixtures of di-tert-butyl polysulfide such as mixtures of di-tert-butyl tri-sulfide, di-tert-butyl tetrasulfide and di-tert-butyl pentasulfide, among others. Combinations of such categories of sulfur-containing antiwear and/or extreme pressure agents can also be used, such as a combination of sulfurized isobutylene and di-tert-butyl trisulfide, a combination of sulfurized isobutylene and dinonyl trisulfide, a combination of sulfurized tall oil and dibenzyl polysulfide.

For purposes of this invention a component which contains both phosphorus and sulfur in its chemical structure is deemed a phosphorus-containing antiwear and/or extreme pressure agent rather than a sulfur-containing antiwear and/or extreme pressure agent.

Use can be made of a wide variety of phosphorus-containing oil-soluble antiwear and/or extreme pressure additives such as the oil-soluble organic phosphates, organic phosphites, organic phosphonates, organic phosphonites, etc., and their sulfur analogs. Also useful as the phosphorus-containing antiwear and/or extreme pressure additives that may be used in the present invention include those compounds that contain both phosphorus and nitrogen. Phosphorus-containing oil-soluble antiwear and/or extreme pressure additives useful in the present invention include those compounds taught in U.S. Pat. Nos. 5,464,549; 5,500,140; and 5,573,696, the disclosures of which are hereby incorporated by reference.

One such type of phosphorus- and nitrogen-containing antiwear and/or extreme pressure additives which can be employed in the practice of the invention are the phosphorus- and nitrogen-containing compositions of the type described in GB 1,009,913; GB 1,009,914; U.S. Pat. Nos. 3,197,405 and 3,197,496. In general, these compositions are prepared by forming an acidic intermediate by the reaction of a hydroxy-substituted triester of a phosphorothioic acid with an inorganic phosphorus acid, phosphorus oxide or phosphorus halide, and neutralizing a substantial portion of said acidic intermediate with an amine or hydroxy-substituted amine. Other types of phosphorus- and nitrogen-containing antiwear and/or extreme pressure additive that may be used in the compositions of this invention include the amine salts of hydroxy-substituted phosphetanes or the amine salts of hydroxy-substituted thiophosphetanes and the amine salts of partial esters of phosphoric and thiophosphoric acids.

Some additive components are supplied in the form of solutions of active ingredient(s) in an inert diluent or solvent, such as diluent oil. Unless expressly stated to the contrary, the amounts and concentrations of each additive component are expressed in terms of active additive, i.e., the amount of solvent or diluent that may be associated with such component as received is excluded.

Commercially available gear additive packages that may be used in the compositions of the present invention include HiTEC® 381 Performance Additive, HiTEC® 385 Performance Additive and HiTEC® 388 Performance Additive, commercially available from Ethyl Corporation. Factors to consider when determining additive selection and level include needs in axle efficiency, trailer tow durability, GL 5 tests, deposit control, seal compatibility, bearing life and limited slip performance.

The lubricating oil compositions of the present invention may further contain from 0 to 20 weight percent of a seal swell agent. Suitable seal swell agents include hindered polyol esters and oil-soluble diesters. The preferred diesters include the adipates, azelates, and sebacates of $C_8$–$C_{13}$ alkanols (or mixtures thereof), and the phthalates of $C_4$–$C_{13}$ alkanols (or mixtures thereof). Mixtures of two or more different types of esters (e.g., dialkyl adipates and dialkyl azelates, etc.) can also be used. Examples of such materials include the n-octyl, 2-ethylhexyl, isodecyl, and tridecyl diesters of adipic acid, azelaic acid, and sebacic acid, and the n-butyl, isobutyl, pentyl, hexyl, heptyl, octyl, nonyl, decyl, undecyl, dodecyl, and tridecyl diesters of phthalic acid. Specific examples include di-2-ethylhexyl adipate, di-isooctyl adipate, (2-ethylhexyl)(isodecyl) adipate, di-2-ethylhexyl sebacate and di-isodecyl adipate.

For certain applications, pour point depressants may be added to the lubricant formulation. If present, the lubricant formulations typically can contain up to 5 wt. % of the pour point depressant.

The compositions of the present invention may contain at least one viscosity index improver. Viscosity index improvers suitable for use in the present invention include olefin (co) polymer(s), polyalkyl (meth) acrylate(s), vinyl aromatic-diene copolymers and mixtures thereof. The molecular weight and the amount of the viscosity index improving polymers used should be selected such that the formulated oil will not shear out of grade according to SAE J306 JUL98 requirements when subjected to the 20-hour taper bearing shear test (CEC-L45-T-93). Typically, the viscosity index improver, when used, will be present in an amount of from 0.1 to 30 weight percent.

The olefin (co) polymer viscosity index improvers useful in the present invention comprises at least one homopolymer or copolymer resulting from the polymerization of $C_2$–$C_{14}$ olefins and having a number average molecular weight of from 250 to 50,000, preferably 1,000 to 25,000, as determined by gel permeation chromatography (GPC). The $C_2$–$C_{14}$ olefins include ethylene, propylene, 1-butene, isobutylene, 2-butene, 1-octene, 1-decene. 1-dodecene and 1-tetradecene. Preferred (co) polymers include polypropylene, polyisobutylene, ethylene/propylene copolymers, ethylene/butene copolymers and 1-butene/isobutylene copolymers. A polyisobutylene having a number average molecular weight of from about 800 to 5000, preferably 1000 to 3000, is a particularly preferred olefin polymer. The olefin homopolymers suitable for use in the present invention also include high viscosity polyalphaolefins having a kinematic viscosity (KV) of at least 40 cSt, preferably from 40 to 3000 cSt, as measured at 100° C. according to ASTM D-445.

The high viscosity polyalphaolefins may be prepared by any of a series of methods described in the literature. The catalysts employed include those commonly referred to as Friedel-Crafts catalysts. Such catalysts cause cationic oligomerization of alpha-olefins, such as 1-octene and 1-decene, to molecular weights ranging up to several thousand depending on the catalyst and the polymerization conditions employed. Ziegler catalysts, such as those described in U.S. Pat. No. 3,179,711 to Sun Oil Company can also be used to prepare oligomers in the molecular weight range useful in the present invention. Polyalphaolefins can likewise be prepared with peroxide catalysts, $BF_3$ based catalysts and by thermal polymerization. These methods, however, generally only produce low molecular weight oligomers.

The high viscosity polyalphaolefins suitable for use in the present invention are preferably hydrogenated to decrease their level of unsaturation and thereby increase their stability toward oxidation.

The alpha-olefins utilized to make the high viscosity oligomers of the present invention can range from $C_3$–$C_{14}$ or any mixtures thereof, although oligomers of octene-1, decene-1 and dodecene-1 are preferred because of their high Viscosity Indices and low pour points.

Olefin copolymers particularly suitable for the present invention are ethylene-alpha-olefin copolymers comprising ethylene and one or more alpha-olefins of the formula $H_2C{=}CHR$ wherein R is a hydrocarbon radical of from 1 to 10 carbon atoms. The copolymer-forming monomers can optionally include a nonconjugated polyene. Preferred alpha-olefins include propylene, 1-butene, 1-pentene, 1-hexene, 3-methyl pentene, 1-heptene, 1-octene and 1-decene. The optional nonconjugated polyenes include aliphatic dienes such as 1,4-hexadiene, 1,5-hexadiene, 1,4-pentadiene, 2-methyl-1,4-pentadiene, 3-methyl-1,4-hexadiene, 4-methyl-1,3-hexadiene, 1,9-decadiene, and exo- and endo-dicyclopentadiene; exo- and endo-alkenylnorbornenes such as 5-propenyl-, 5-(buten-2-yl)- and 5-(2-methylbuten-[2']-yl) norbornene; alkylalkenylnorbornenes such as 5-methyl-6-propenylnorbornene; alkylidenenorbornenes such as 5-methylene, 5-ethylidene and 5-isopropylidene-2-norbornene, vinylnorbornene and cyclohexylnorbornene; alkylnorbornadienes such as methyl-, ethyl- and propylnorbornadiene; and cyclodienes such as 1,5-cyclooctadiene and 1,4-cyclooctadiene.

The ethylene content of the olefin copolymers is generally from about 35 to about 65, and most preferably from about 40 to 60, weight percent. When present, the nonconjugated polyene generally ranges from about 1 to about 25, preferably from about 2 to about 20, and most preferably from about 4 to about 17, weight percent. The balance of the copolymers, for a total of 100 weight percent, is made up of alpha-olefins other than ethylene.

The olefin copolymers can be prepared in accordance with known procedures employing Ziegler-Natta catalysts or metallocene catalysts. The olefin copolymers generally possess a number average molecular weight (Mn) of from about 250 to about 50,000, preferably from about 1,000 to about 25,000.

The polyalkyl (meth) acrylates suitable for use in the present invention are prepared by the polymerization of $C_1$–$C_{30}$ (meth) acrylates. Preparation of these polymers may further include the use of acrylic monomers having nitrogen-containing functional groups, hydroxy groups and/or alkoxy groups which provide additional properties to the polyalkyl (meth) acrylates such as improved dispersancy. The polyalkyl (meth) acrylates preferably have a number average molecular weight of from 10,000 to 250,000, preferably 15,000 to 100,000. The polyalkyl (meth) acrylates may be prepared by conventional methods of free-radical or anionic polymerization.

The vinyl aromatic-diene copolymers particularly suitable for the present invention include hydrogenated diene/vinyl aromatic diblock and triblock copolymers. These copolymers are typically prepared from, first, a vinyl aromatic monomer. The aromatic portion of this monomer can comprise a single aromatic ring or a fused or multiple aromatic ring. Examples of fused or multiple aromatic ring materials include vinyl substituted naphthalenes, anthracenes, phenanthrenes and biphenyls. The aromatic comonomer may also contain one or more heteroatoms in the aromatic ring, provided that the comonomer substantially retains its aromatic properties and does not otherwise interfere with the properties of the polymer. Suitable heteroaromatic materials include vinyl-substituted thiophene, 2-vinylpyridine, 4-vinylpyridine, N-vinylcarbazole and N-vinyloxazole. Preferably, the monomers are styrenes such as styrene, alpha-methyl styrene, ortho-methyl styrene, meta-methyl styrene and para-methyl styrene. Most preferably, the vinyl aromatic monomer is styrene. The vinyl group in the vinyl aromatic monomer is preferably an unsubstituted vinyl (e.g., $CH_2{=}CH$—) group, or an equivalent group of such a nature that it provides adequate means of incorporation of the aromatic comonomer into the polymer chain as a "block" of homopolymer, having a number of consecutive uniform repeating units, which imparts a high degree of aromatic content to the block.

The dienes suitable for preparing the block copolymers of the present invention contain two double bonds, commonly located in conjugation in a 1,3 relationship. Olefins containing more than two double bonds, sometimes referred to as polyenes, are also considered to be within the definition of "dienes" as used herein. Examples of such diene monomers include 1,3-butadiene as well as hydrocarbyl-substituted butadienes such as isoprene and 2,3-dimethylbutadiene. Mixtures of such conjugated dienes are also useful.

The vinyl aromatic content of the copolymers is typically in the range of about 20% to about 70% by weight, preferably about 40% to about 60% by weight. The remaining comonomer content of these copolymers is typically in the range of about 30% to about 80% by weight, preferably about 40% to about 60% by weight. Additional monomers may also be present, normally in relatively small amounts (e.g., about 5 to about 20 percent). These additional monomers include $C_{2-10}$ olefin oxides, capralactone and butyrolactone.

The di- and tri-block copolymers useful in the present invention are preferably made by anionic polymerization, using a variety of techniques and altering reaction conditions to produce the desired features in the resulting copolymer. Hydrogenation of the unsaturated block polymers produces polymers that are more oxidatively and thermally stable. Hydrogenation is typically carried out as part of the polymerization process, using finely divided, or supported, nickel catalyst. Other transition metals may also be used to effect the transformation. Hydrogenation is normally carried out to reduce at least about 94% of the olefinic unsaturation of the initial polymer. In general, it is preferred that these copolymers, for reasons of oxidative stability, contain no more than about 5% and more preferably no more than about 0.5% residual olefinic unsaturation on the basis of the total amount of olefinic double bonds present in the polymer prior to hydrogenation. Such unsaturation can be measured by a number of means well known to those skilled in the art, such as infrared or nuclear magnetic resonance spectroscopy. Most preferably, these copolymers contain no discernible unsaturation, as determined by the aforementioned analytical techniques.

The polymers, and in particular styrene-diene copolymers, are, in a preferred embodiment, block copolymers in which a portion of the blocks are composed of homopolymer of homo-oligomer segments of the vinyl aromatic monomer and another portion of the blocks are composed of homopolymer or homo-oligomer segments of the diene monomer. The polymers generally possess a number average molecular weight of at least 50,000, preferably at least 100,000. Generally, the polymers should not exceed a number average molecular weight of 500,000 preferably 300,000. The number average molecular weight for such polymers is determined by gel permeation chromatography (GPC).

Suitable styrene/isoprene hydrogenated regular diblock copolymers are available commercially from Shell Chemical Co., for example, under the SHELLVIS® tradename. Suitable styrene/1,3-butadiene hydrogenated random block copolymers are available from BASF under the GLISSOVISCAL tradename.

The vinyl aromatic-diene copolymers particularly suitable for the present invention also include star polymers. Star polymer are polymers comprising a nucleus and polymeric arms. Common nuclei include polyalkenyl compounds, usually compounds having at least two non-conjugated alkenyl groups, usually groups attached to electron withdrawing groups, e.g., aromatic nuclei. The polymeric arms are copolymers of conjugated dienes and vinyl aromatic compounds.

The star polymers are typically hydrogenated such that at least 80%, preferably at least 95%, of the covalent carbon-carbon double bonds are saturated. The polyvinyl compounds making up the nucleus are illustrated by polyalkenyl arenes, e.g., divinyl benzene and poly vinyl aliphatic compounds. These star polymers are commercially available, for example SHELLVIS® 200 sold by Shell Chemical Co.

Supplemental friction modifiers may be included in the gear oil compositions of the present invention. The use of additional friction modifiers can enhance performance of the gear oils in elastohydrodynamic, mixed and boundary lubricating regimes. The amount of these supplemental friction modifiers employed in the gear oil compositions of the present invention is preferably in the range of from 0 to 10 wt. %, more preferably from 0 to 5 wt. %, most preferably 0 to 1.25 wt. %. Suitable supplemental friction modifiers for use in the compositions of the present invention include, but are not limited to, such compounds as fatty amines, alkoxylated fatty amines, borated alkoxylated fatty amines, borated fatty epoxides, aliphatic fatty acid amides, ethoxylated aliphatic ether amines, aliphatic carboxylic acids, aliphatic carboxylic ester-amides, aliphatic phosphonates, aliphatic phosphates, aliphatic thiophosphonates, aliphatic thiophosphates, fatty imidazolines, fatty tertiary amines, fatty phosphites etc., wherein the aliphatic group usually contains above about eight carbon atoms so as to render the compound suitably oil soluble.

Also suitable are aliphatic substituted succinimides as described in U.S. Pat. Nos. 5,021,176; 5,190,680; and RE-34,459 the relevant disclosures of which are herein incorporated by reference. These succinimides are formed by reacting one or more aliphatic succinic acids or anhydrides with ammonia or other primary amines.

Fatty acid esters of glycerol, such as glycerol monooleate and glycerol tallowate, may be used as the supplemental friction modifiers of the present invention. These fatty acid esters may be prepared by a variety of methods well known in the art. The fatty acid esters of glycerol are typically mixtures of from 45% to 55% by weight monoester and from 55% to 45% diester.

Other supplemental friction modifiers include the N-aliphatic hydrocarbyl-substituted diethanol amines and N-aliphatic hydrocarbyl-substituted trimethylene diamines in which the N-aliphatic hydrocarbyl-substituent is at least one straight chain aliphatic hydrocarbyl group free of acetylenic unsaturation and having in the range of about 14 to about 20 carbon atoms; di(hydroxyalkyl) aliphatic tertiary amines in which the hydroxyalkyl groups, being the same or different, each contain from 2 to about 4 carbon atoms, and in which the aliphatic group is an acyclic hydrocarbyl group containing from about 10 to about 25 carbon atoms; hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms as well as mixtures of these friction modifiers. Further details concerning these friction modifiers are set forth in U.S. Pat. Nos. 5,344,579; 5,372,735 and 5,441,656, incorporated herein by reference.

The lubricant formulations of the present invention are particularly suitable for use in automotive gear applications such as final drives, power-dividers or axles in light and heavy-duty vehicles or manual transmissions in a truck or heavy equipment and industrial gear applications.

Preferred finished lubricant formulations for automotive gear applications utilize components proportioned such that the lubricant formulations preferably have an SAE Viscosity Grade of at least SAE 70W, and preferably at least 75W, according to SAE J306 JUL98. The lubricant formulations may also have multi-grade ratings including SAE 75W-80, 75W-90, 80W-140. It is critical that the components used for formulating the lubricant formulations of the present invention are selected such that the formulated oil will not shear out of grade according to SAE J306 requirements when subjected to the 20-hour taper bearing shear test (CEC-L45-T-93). Preferably, the lubricant compositions have a viscosity loss at 100° C. of less than about 15% in the 20-hour taper bearing shear test.

Preferred finished lubricant formulations for industrial gear applications utilize components proportioned such that the lubricant formulations have a viscosity classification of ISO 32 or higher according to AGMA 9005-D94.

In another embodiment, the present invention is directed to the use of the reaction product (B) as an additive for increasing axle efficiencies, lowering axle temperatures, improving limited slip performance, frictional durability, reduced chatter and/or improving power divider performance. Lubricating oil formulations may be prepared by adding component (B) in any manner, for example in a concentrate, alone, or in combination with other additives as set forth above. The reaction products may be present in the gear additive package or added separately in preparing fully formulated lubricating oils.

Another area where the additives of the present invention are useful is the area of lubricant top treats. These top treats are added to the existing gear oil present in the vehicle or machine in order to boost the performance of the existing lubricant. Top treats typically contain much higher additive levels compared to a fully formulated gear lubricant. An embodiment of the present invention comprises a concentrate, useful as a top treat additive, comprising the reaction product of at least one $C_5$–$C_{60}$ carboxylic acid and at least one amine selected from the group consisting of guanidine, aminoguanidine, urea, thioruea and salts thereof (B) in an amount so as to provide from about 0.01 to about 5 wt. %, of (B) to the finished lubricant at the recommended treat rates of the concentrate; optionally (C) a gear additive package; and (D) a diluent. The diluent may be any fluid in which (B) and (C) are soluble in the above-described amounts. The diluent may be a natural or synthetic oil or some other solvent for components (B) and (C). In a preferred embodiment, the diluent is a mineral oil of lubricating viscosity.

One embodiment of the present invention comprises a method of providing limited slip performance comprising the step of introducing the lubricant composition described herein to a differential or transmission, and operating the differential or transmission.

In one embodiment, the present invention is directed to a method for improving the overall performance of a power divider comprising using as the lubricant for said power divider a lubricant formulation containing the reaction product (B), wherein the performance of the power divider using said lubricant formulation is improved, as compared to said power divider operated in the same manner and using the same lubricant except that the lubricant is devoid of said component (B). For example, performance in the power divider may be improved by reducing or eliminating chatter in the power divider, reducing wear in the power divider and reducing the incidents of axle shaft breakage caused by poor power divider performance.

The present invention is directed to a method of reducing sump temperatures in an axle comprising using as the lubricant for said axle a lubricant formulation containing the reaction product (B), wherein the sump temperature in said axle operated using said lubricant formulation is lower than the sump temperature of said axle operated in the same manner and using the same lubricant except that the oil is devoid of said component (B).

The present invention is also directed to a method of increasing the efficiency of an axle comprising using as the lubricant for said axle a lubricant formulation containing the reaction product (B), wherein the efficiency of the axle using said lubricant formulation is increased, as compared to said axle operated in the same manner and using the same lubricant formulation except that the lubricant is devoid of component (B).

EXAMPLES

The following Examples demonstrate the improvements in Axle Efficiency and the reduction in axle sump temperatures obtained by using the lubricating compositions of the present invention. Mineral oil based SAE 80W-90 gear oils were prepared comprising 8.25 wt. % of a gear additive package meeting the requirements of API GL-5 and MIL-PRF-2105E, 15 wt. % of a diester seal swell agent, 20 wt. % of a polyisobutene viscosity modifier, 10 wt. % of a 100 cSt PAO viscosity modifier and the additional components set forth in the following Table. All of the gear oil formulations contained a hydrotreated 70N mineral oil in an amount to bring the total of all components to 100 wt. %.

The gear oils were subjected to a cycling test to simulate various conditions that a gear oil may be subjected. The results are set forth in Table 1. The sequences differed by the speed and/or torque applied to the axle. Severe driving conditions were simulated using medium speed/high load. The axle sump temperatures were measured for the severe sequence. It is desirable to have low axle sump temperatures.

TABLE 1

| Oil # | Aminoguanidine oleamide[1] (wt. %) | Other Friction Modifiers (wt. %) | Axle Sump Temperature (° F.) |
|---|---|---|---|
| 1* | — | — | 251 |
| 2* | — | 4.51A | 278 |
| 3* | — | 6.52B | 276 |
| 4 | 2 | — | 223 |
| 5 | 4 | — | 217 |
| 6 | 3 | 4.51A | 222 |

*Comparative Example, not within the scope of the present invention
[1]The aminoguanidine oleamide (representative of component B of the present invention) was obtained by reacting oleic acid with aminoguanidine bicarbonate.
A a mixture of a $C_8$ alcohol acid phosphate and a $C_{18}$ amine
B a mixture of a $C_{18}$ acid, a $C_8$ alcohol acid phosphate and a $C_{18}$ amine It is clear, upon examination of the above Table 1, that the compositions of the present invention (Examples 4, 5 and 6) exhibit improved (lower) axle temperatures compared to lubricating compositions outside the scope of the present invention (Comparative Examples 1, 2 and 3).

To further demonstrate the unexpected benefits obtained in the practice of the present invention, additional lubricating oil formulations were prepared using a carboxylic acid derivative outside of the scope of the present invention, i.e., glycerol monooleate. Mineral oil based SAE 80W-90 gear oils were prepared comprising 8.25 wt. % of a gear additive package meeting the requirements of API GL-5 and MIL-PRF-2105E, 10 wt. % of a diester seal swell agent, a glycerol monooleate (GMO) friction modifier and a polyisobutene (PIB) viscosity modifier in the amounts indicated in Table 2. All of the gear oil formulations contained a hydrotreated 70N mineral oil in an amount to bring the total of all components to 100 wt. %.

The gear oils were subjected to a cycling test to simulate various conditions that a gear oil may be subjected. The results are set forth in Table 2. The sequences differed by the speed and/or torque applied to the axle. Severe driving conditions were simulated using medium speed/high load. The axle temperatures were measured for the severe sequence. It is desirable to have low axle temperatures.

TABLE 2

| Oil # | GMO (wt. %) | PIB (wt. %) | Axle Sump Temperature (° F.) |
|---|---|---|---|
| 7* | — | 27.95 | 282 |
| 8* | 0.7 | 26 | 278 |
| 9* | 1.5 | 26 | 279 |

It is clear, upon examination of Table 2, that the addition of GMO to the gear oil formulations had statistically no impact on the Axle Temperatures under severe operating conditions. These data show that not all carboxylic acid derivatives improve axle sump temperature performance under severe operating conditions.

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentee does not intend to dedicate any disclosed embodiments to the public, and to the extent any disclosed modifications or alterations may not literally fall within the scope of the claims, they are considered to be part of the invention under the doctrine of equivalents.

I claim:

1. A lubricant composition comprising:

(A) from about 40 to about 85 weight percent, based on the total weight of the lubricant composition, of an oil of lubricating viscosity;

(B) from about 0.01 to about 5 wt. %, based on the total weight of the lubricant composition, of the reaction product of at least one $C_5$–$C_{60}$ carboxylic acid and at least one amine selected from the group consisting of guanidine, aminoguanidine, urea, thioruea and salts thereof; and (C) from 2 to 25 weight percent, based on the total weight of the lubricant composition, of a gear additive package;

wherein the lubricant composition is an automotive or industrial gear lubricant.

2. The lubricant composition of claim 1 wherein the lubricant composition has an SAE Viscosity Grade of 70W or higher according to SAE J306 JUL98.

3. The lubricant composition of claim 1 wherein the lubricant composition has an ISO Viscosity Grade of 32 or higher according to AGMA 9005-D94.

4. The lubricant composition of claim 1 wherein the oil of lubricating viscosity comprises at least one member selected from the group consisting of natural lubricating oils, synthetic lubricating oils and mixtures thereof.

5. The lubricant composition of claim 4 wherein the oil of lubricating viscosity comprises a mineral oil having a viscosity index greater than 80 and less than 0.03 wt. % sulfur.

6. The lubricant composition of claim 5 wherein the oil of lubricating viscosity comprises a mineral oil having a viscosity index of at least 110.

7. The lubricant composition of claim 4 wherein the oil of lubricating viscosity comprises at least one poly-alpha-olefin having a viscosity in the range of 1 to 12 cSt at 100° C.

8. The lubricant composition of claim 1 wherein said carboxylic acid of component (B) is a $C_{10}$–$C_{40}$ carboxylic acid.

9. The lubricant composition of claim 8 wherein said carboxylic acid of component (B) is a $C_{15}$–$C_{25}$ carboxylic acid.

10. The lubricant composition of claim 9 wherein said carboxylic acid comprises oleic acid.

11. The lubricant composition of claim 1 wherein said reaction product (B) comprises the reaction product of aminoguanidine bicarbonate and oleic acid.

12. The lubricant composition of claim 1 wherein the gear additive package comprises at least one member selected from the group consisting of dispersants, corrosion inhibitors, extreme pressure additives, anti-wear additives, rust inhibitors, antioxidants, deodorizers, defoamers, demulsifiers, dyes, friction modifiers other than component (B) and fluorescent coloring agents.

13. The lubricant composition of claim 12 wherein the gear additive package comprises a gear additive package meeting the requirements API GL-5.

14. The lubricant composition of claim 12 wherein the gear additive package comprises a gear additive package meeting the requirements API MT-1.

15. The lubricant composition of claim 12 wherein the gear additive package comprises a gear additive package meeting the requirements MIL-PRF-2105E.

16. The lubricant composition of claim 12 wherein the gear additive package comprises a gear additive package meeting the requirements AGMA 9005-D94.

17. The lubricant composition of claim 1 further comprising at least one viscosity index improver selected from the group consisting of olefin (co) polymer(s), polyalkyl (meth) acrylate(s), vinyl aromatic-diene copolymers and mixtures thereof.

18. The lubricant composition of claim 17 wherein the viscosity index improver comprises at least one homopolymer or copolymer resulting from the polymerization of $C_2$–$C_{14}$ olefins and having a number average molecular weight of from 250 to 50,000 as determined by gel permeation chromatography.

19. The lubricant composition of claim 17 wherein the viscosity index improver comprises at least one homopolymer or copolymer resulting from the polymerization of $C_2$–$C_{14}$ olefins and having a number average molecular weight of from 1000 to 15,000 as determined by gel permeation chromatography.

20. The lubricant composition of claim 18 wherein the viscosity index improver is a polyisobutylene having a number average molecular weight of from 800 to 5000.

21. The lubricant composition of claim 18 wherein the viscosity index improver comprises an ethylene-alpha-olefin copolymer.

22. The lubricant composition of claim 21 wherein the ethylene-alpha-olefin copolymer has a number average molecular weight of from 1000 to 25,000.

23. The lubricant composition of claim 22 wherein the ethylene-alpha-olefin copolymer has a number average molecular weight of from 7000 to 15,000.

24. The lubricant composition of claim 18 wherein the viscosity index improver comprises a poly-alpha-olefin having a kinematic viscosity of at least 40 cSt as measured at 100° C. according to ASTM D-445.

25. The lubricant composition of claim 17 wherein the viscosity index improver comprises a polyalkyl (meth) acrylate.

26. The lubricant composition of claim 17 wherein the molecular weight and the amount of the viscosity index improvers is selected such that the formulated oil will not shear out of grade according to SAE J306 JUL98 requirements when subjected to the 20-hour taper bearing shear test (CEC-L45-T-93).

27. A method of increasing the efficiency of an axle comprising using as the lubricant for said axle the lubricant composition of claim 1, wherein the efficiency of the axle using said lubricant composition is increased, as compared to said axle operated in the same manner and using the same lubricant composition except that the lubricant is devoid of component (B).

28. A process for improving the limited slip character of a gear or transmission lubricant comprising the steps of (1) providing a top treatment comprising the reaction product of at least one $C_5$–$C_{60}$ carboxylic acid and at least one amine selected from the group consisting of guanidine, aminoguanidine, urea, thioruea and salts thereof and (2) adding the top treatment to a gear or transmission lubricant composition comprising a major amount of an oil of lubricating viscosity and a gear additive package.

29. A method of lubricating a gear or transmission comprising adding to a gear box, differential or transmission the lubricant composition of claim 1.

* * * * *